US005572855A

United States Patent [19]

Reigrut et al.

[11] Patent Number: 5,572,855

[45] Date of Patent: Nov. 12, 1996

[54] STRETCH WRAPPING TAPE DISPENSING APPARATUS

[75] Inventors: Lawrence P. Reigrut, Youngstown; Robert Simons, Newton Falls, both of Ohio

[73] Assignee: Liberty Industries, Girard, Ohio

[21] Appl. No.: 370,421

[22] Filed: Jan. 9, 1995

[51] Int. Cl.[6] ..... B65B 53/00; B65B 11/04

[52] U.S. Cl. ..... 53/556; 53/587

[58] Field of Search ..... 53/399, 441, 556, 53/587

[56] References Cited

U.S. PATENT DOCUMENTS

| | | | |
|---|---|---|---|
| 4,200,963 | 5/1980 | Kamfe et al. . | |
| 4,368,565 | 1/1983 | Schwarz . | |
| 4,374,690 | 2/1983 | Canterino et al. . | |
| 4,387,552 | 6/1983 | Lancaster et al. . | |
| 4,418,510 | 12/1983 | Lancaster, III et al. . | |
| 4,458,467 | 7/1984 | Shulman et al. . | |
| 4,693,049 | 9/1987 | Humphrey . | |
| 4,706,443 | 11/1987 | Humphrey . | |
| 4,807,427 | 2/1989 | Casteel et al. . | |
| 5,195,296 | 3/1993 | Matsumoto . | |
| 5,195,297 | 3/1993 | Lancaster et al. | 53/441 X |
| 5,314,557 | 5/1994 | Schwartz et al. | 53/399 X |
| 5,351,461 | 10/1994 | Fandard et al. . | |
| 5,450,711 | 9/1995 | Martin-Cocher | 53/587 X |

*Primary Examiner*—Linda Johnson
*Attorney, Agent, or Firm*—Harpman & Harpman

[57] ABSTRACT

An apparatus for dispensing and applying stretchable adhesive tape to unitize a multiple unit load. The apparatus includes a tape dispenser head on a movable carriage that pre-stretches a narrow band of adhesive tape around a load positioned on an adjacent turn table in a spiral wrapping configuration as the movable carriage ascends and descends vertically in relation to the load while a secondary movable carriage having a tape supply moves within the tape dispenser carriage. Textured pre-stretch rollers and adjacent guides elongate and guide the adhesive tape within the tape dispensing carriage.

10 Claims, 6 Drawing Sheets

STRETCH WRAPPING TAPE DISPENSING APPARATUS

BACKGROUND OF THE INVENTION

1. Technical Field

The present invention relates to stretch wrapping devices that dispense a pre-stretch film band of stretchable plastic film around a load confining the material within to a unified package for ease of transportation and handling.

2. Description of Prior Art

Prior art devices of this type are unknown to the applicant when an adhesive synthetic resin based narrow tape is pre-stretched and wrapped around a load to unitize same. Many examples of pre-stretch film dispensing devices are known within the art, for example, U.S. Pat. Nos. 4,387,552, 4,458,464, 4,693,049, 4,418,510, and 4,706,443. Additional prior art is directed to stretch wrapping loads with an elongated continuous band of plastic rope formed from gathering a film band into a narrow dispensing guide, see U.S. Pat. No. 4,807,427. Finally, in U.S. Pat. No. 5,351,461 is directed towards the installation for packaging a palletized band discloses the use of microcreped stretchable paper tape on which adhesive is deposited on the paper tape that is to be immediately covered by a following tape winding.

Film orientation and transverse stretching utilizing roller configurations is seen in U.S. Pat. Nos. 4,374,690 and 5,195,296 and 4,368,565 respectively by the utilization of contoured interengaging rollers and adjacent fixed guides against spiral rolled roller surfaces, see U.S. Pat. No. 4,200,963.

SUMMARY OF THE INVENTION

The present invention generally comprises an improvement in stretch wrapping apparatus for the dispensing and pre-stretching of self-adhesive plastic narrow tape band about a multiple unit load for unitizing same. A pair of respective inter-independent movable tape dispensing and storage carriages dispense in pre-stretch self-adhesive tape band from textured pre-stretching rolls and non-stick roller guides spirally around a palletized load on an adjacent rotating turn table with a vertically ascending and descending wrapping cycle with a disengageable pre-stretch roller drive that terminates pre-stretch as required for wrapping configurations at the end of the cycle.

DESCRIPTION OF THE PREFERRED EMBODIMENT

Figure 1:
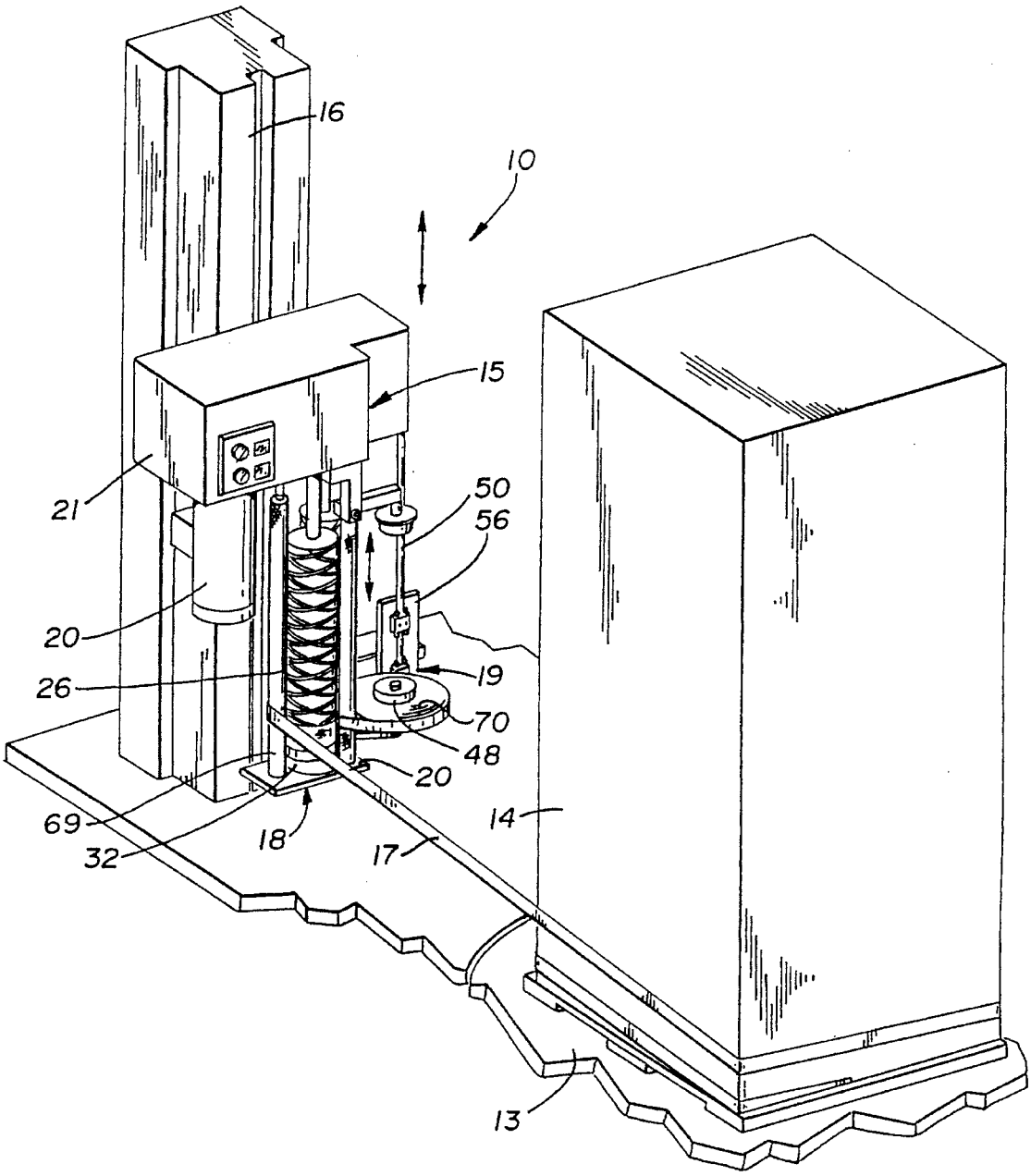
FIG. 1 is a perspective view of the adhesive tape dispensing apparatus.

Referring to FIGS. 1–5 of the drawings a stretch wrapping device 10 can be seen having a turn table 13 in spaced relation thereto on which a palletized load 14 can be positioned for wrapping. The stretch wrapping device 10 comprises an adhesive tape dispensing and elongation head 15 movably positioned on a support and drive column 16. A tape band 17 of elongated tape extends from said elongation head for manual positioning on the load 14 on the turn table 13.

Figure 5:
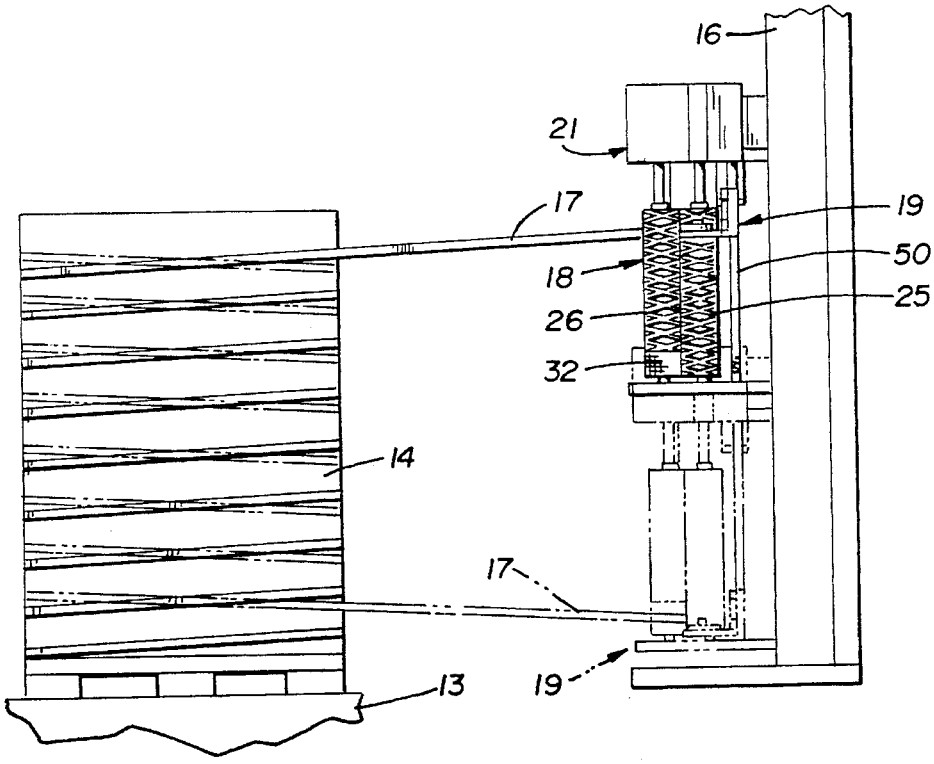
FIG. 5 is a side elevational view of the dispensing apparatus and load of FIG. 1.

The adhesive tape dispensing head 15 of the invention comprises a pair of inter-independent movable carriage assemblies 18 and 19 that are reciprocated vertically along the support column 16 as the palletized load 14 rotates on the turn table 13 as best seen in FIG. 5 of the drawings. The tape dispensing carriage assembly 18 comprising a mounting and support frame 20 having a roller drive assembly 21 associated therewith. A roller drive motor 22 of the roller drive assembly 21 is secured from a mounting plate 23 of a drive assembly's frame 24. A pair of elongated rollers 25 and 26 are rotatably secured from said mounting plate 23 to respective bearing supports 27 and 28 on the mounting and support frame 20. Each of the rollers 25 and 26 have textured rubber roller bodies 25A and 26A having a pair of intersecting counter directional spaced spiral grooves 29 and 30 within the rubber roller body surfaces, best seen in FIG. 2 of the drawings. The spiral grooves 29 and 30 cross one another as they respectively vertically ascend and descend the roller body surfaces defining a plurality of onmi-directional diamond shaped areas 31 therebetween. The roller 26 has a smooth plastic sleeve 32 extending inwardly from its lower end which will be discussed in greater detail hereinafter.

Each of the rollers 25 and 26 are mounted on an axial drive and mounting shaft 25B and 26B respectively which extends into the roller drive assembly 21.

Figure 2:
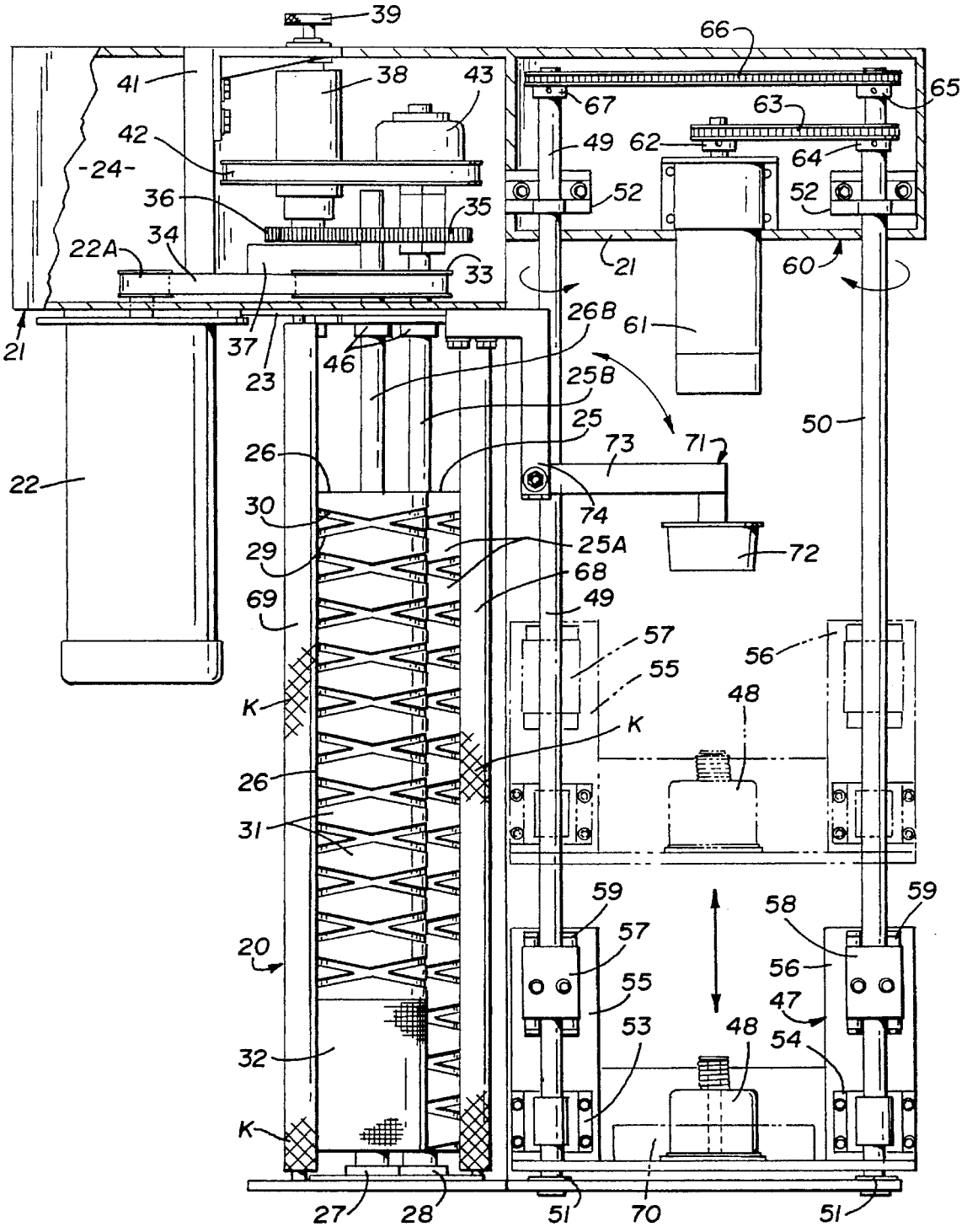
FIG. 2 is a front plan view thereof.
Figure 3:
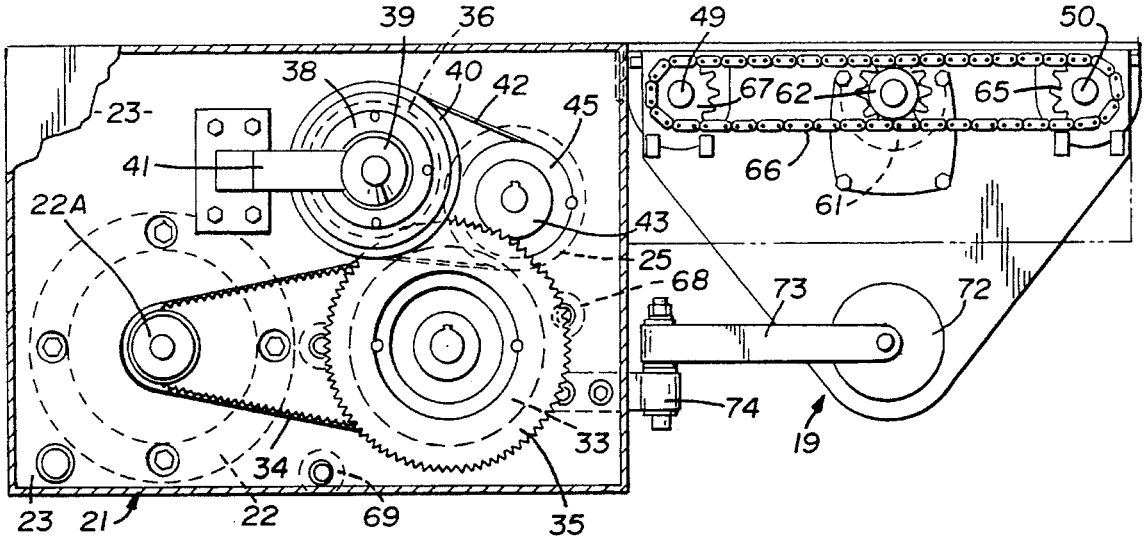
FIG. 3 is a top plan view of the roller and secondary carriage drive assembly.
Figure 7:
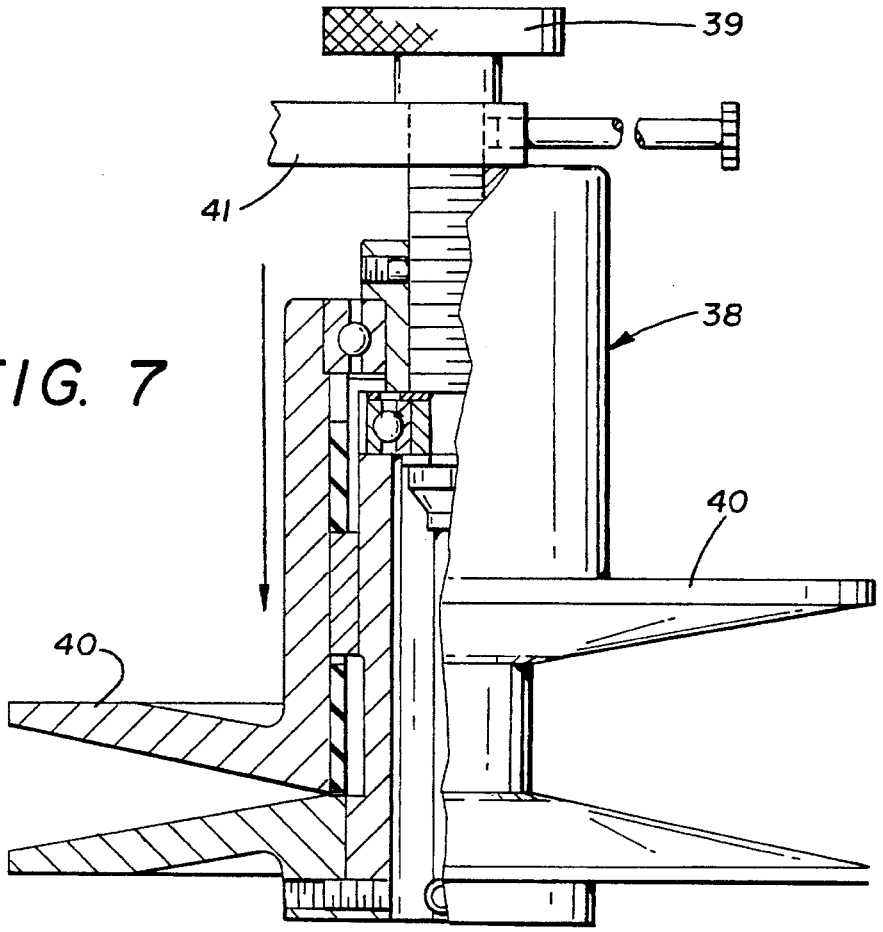
FIG. 7 is a partial cross-sectional view of an adjustable pre-stretch sheave.

Referring now to FIGS. 2 and 3 of the drawings, the drive and mounting shaft 26B has a drive belt pulley 33 engaged by a drive belt 34 from a drive pulley 22A on the drive motor 22. A spur gear 35 on the drive and mounting shaft 26B engages a spur gear 36 on an input shaft of a release clutch assembly 37 driving a film adjustment sheave 38 also seen in FIG. 7 of the drawings. The adjustment sheave 38 allows for selective drive tension adjustment by rotation of the hand wheel 39 and the interdependent opposing movable disk assembly element 40. Such adjustable sheaves are well known within the art and are available as off the shelf components such as "High Low" brand model MCW600 and MCW70.

An upstanding mounting support arm 41 extends from the mounting plate 23 and supports the hereinbefore described adjustable sheave 28.

A secondary belt 42 interconnects the adjustable sheave 38 with a spring loaded take-up sheave assembly 43 mounted on the end of the drive and mounting shaft 25B of the elongated roller 25.

Figure 6:
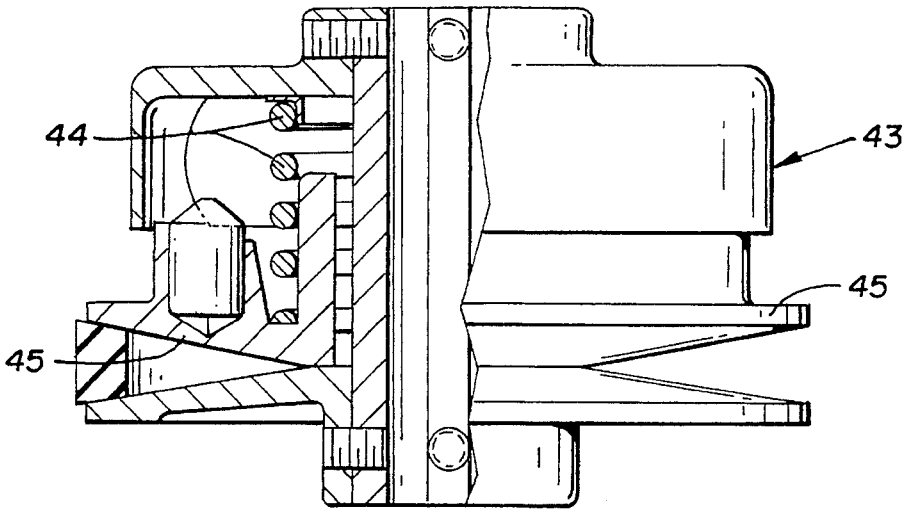
FIG. 6 is a partial cross-sectional view of a take up sheave.

The spring loaded take-up sheave assembly 43 has a spring 44 and engagement with a movable belt engagement disk element 45 which effects a preset tension thereon. Such spring loaded take-up sheave assemblies 43 are of a type that is well known to those skilled in the art and is available commonly off the shelf from a number of manufacturers, an example of same is illustrated in FIG. 6 of the drawings.

Referring now back to FIG. 2 of the drawings, shaft bearings 46 are positioned on the respective drive and mounting shafts 25B and 26B within the support plate 23 as will be well known to those skilled in the art.

The adhesive tape dispensing carriage assembly 19 can be seen comprising a movable tape support frame 47 having a film/tape center core chuck 48 thereon. A pair of parallel drive rails 49 and 50 in horizontal spaced aligned relation to one another extend between respective base support bearings 51 on the support frame 20 and linear support bearing assemblies 52 on the drive assembly frame 21.

A pair of secondary linear bearings 53 and 54 are secured to respective upstanding support frame elements 55 and 56 and are engaged on the rails 49 and 50 respectively in spaced relation to the film/tape center core chuck 48.

Figure 9:
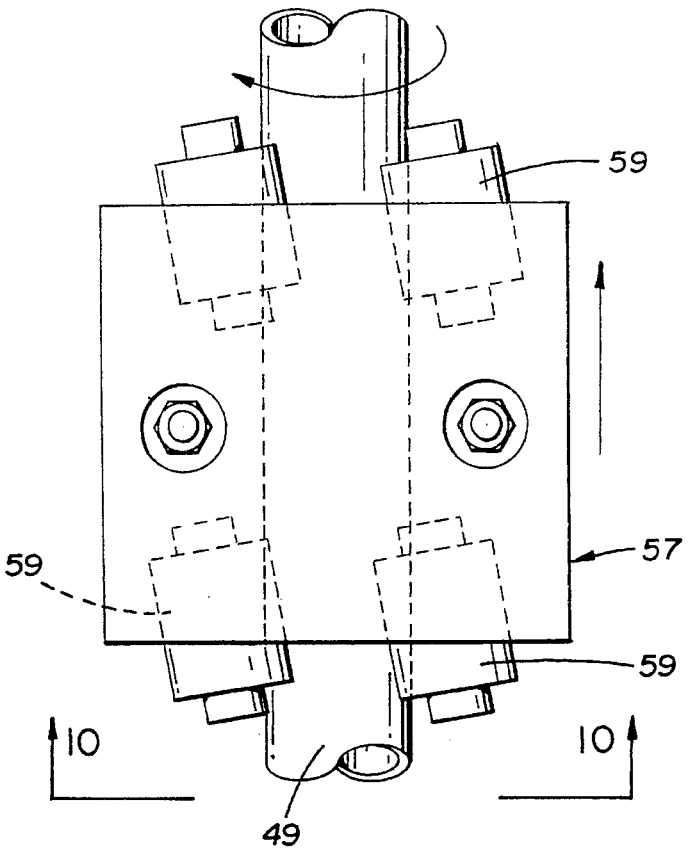
FIG. 9 is an enlarged front plan view of an linear actuator bearing.
Figure 10:
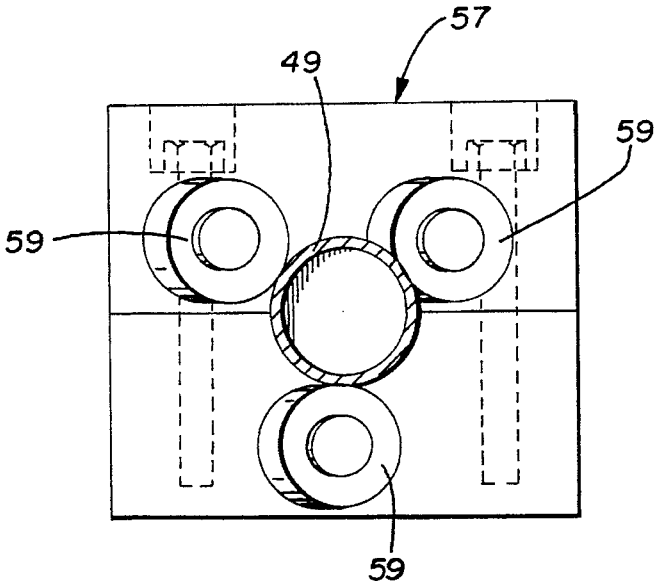
FIG. 10 is an end plan view on lines 10—10 of FIG. 9.

A pair of linear actuator bearing assemblies 57 and 58 are positioned on the support frame elements 55 and 56 and engage respective drive rails 49 and 50 in longitudinally spaced relation to the linear bearings 53 and 54. Referring to FIGS. 9 and 10 of the drawings, the linear actuation bearing 57 can be seen having a plurality of angularly aligned sub-bearing assemblies 59 which are arranged so as to provide linear drive movement to the bearing assembly upon rotation of the respective drive rail 49 as is well known to those skilled in the art.

A power drive rail assembly 60 is positioned on the drive assembly frame 21 and comprises a core clutch drive motor 61 having a drive sprocket 62 from which an associated drive chain 63 engages an aligned drive sprocket 64 on the drive rail 50 above the respective drive bearing 52. A second drive sprocket 65 is secured to the free end of the drive rail 50 having a second drive chain 66 engageable thereon that extends to a third drive sprocket 67 on the free end of the drive rail 49.

It will be apparent from the above description that the drive rails 49 and 50 are both rotatably driven about their longitudinal axis at the same speed and direction when activated.

Figure 4:
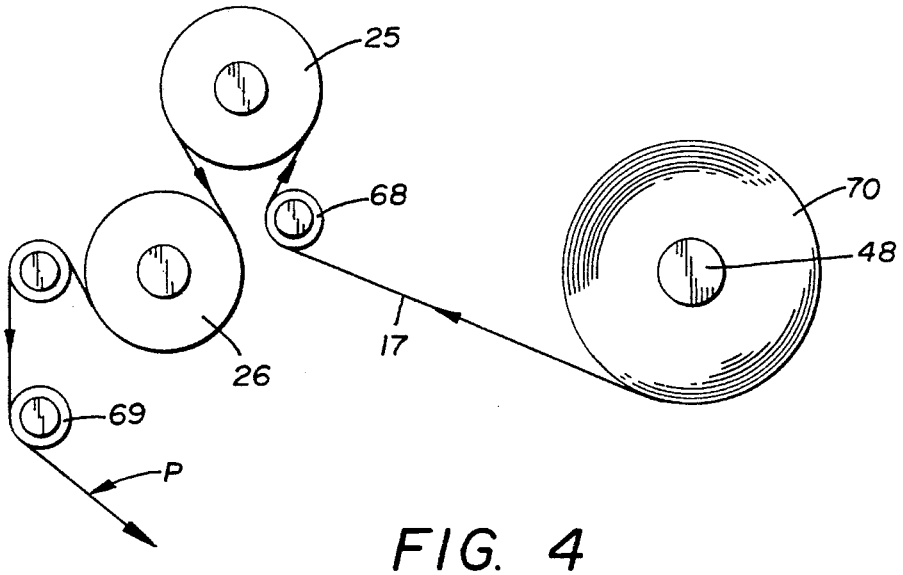
FIG. 4 is a graphic illustration of the adhesive tape pre-stretch and dispensing path.

Referring now to FIGS. 2, 3 and 4 of the drawings, tape guide bars 68 and 69 can be seen within the tape dispensing carriage assembly 20 extending between the respective mounting plate 23 and the base of the support frame 20 adjacent the hereinbefore disclosed rollers 25 and 26. The guide bars 68 and 69 have a knurled surface K for reduced tactal engagement with the adhesive tape band 17 as will be disclosed in greater detail hereinafter. The tape guide bar 68 is positioned adjacent both rollers 25 and 26 facing the adhesive tape dispensing carriage assembly 19. The tape guide bar 69 is positioned adjacent the roller 26 which with the roller 25 and guide bar 68 defines a tape transit path P from a tape supply roll 70 on the film/tape center core chuck 48 in the tape dispensing carriage 19 as best seen in FIG. 4 of the drawings.

Figure 8:
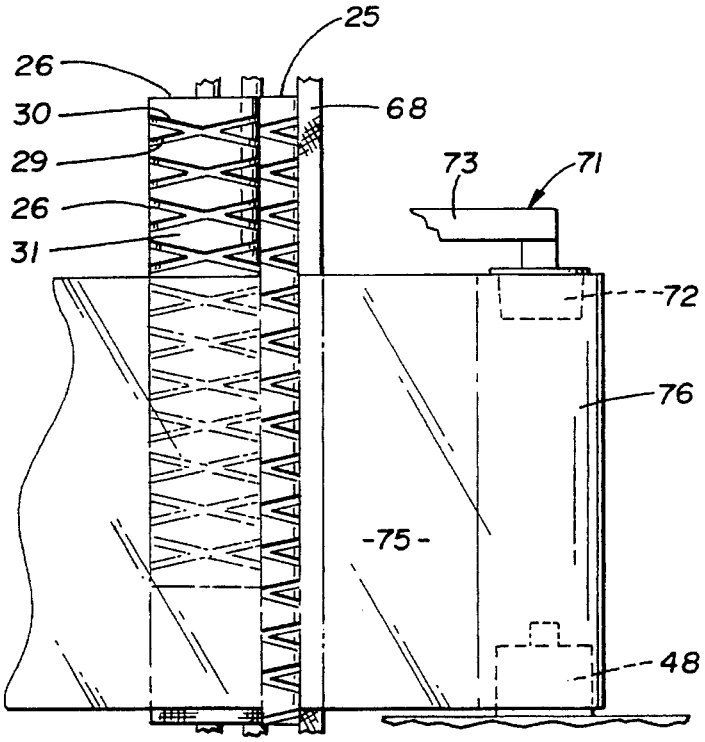
FIG. 8 is an enlarged front plan view of an alternate film use configuration.

In operation, a palletized load 14 is positioned on the turn table 13 and the adhesive tape band 17 is manually engaged onto the load 14. The turn table 13 begins a rotation sequence and the adhesive tape band 17 is pulled from the tape dispensing and elongation head 15. As the tape band 17 travels through the tape dispensing path P, the rubber rollers 25 and 26 are being effectively driven at different speeds elongating (pre-stretching) the tape band 17 as it loops about and around the respective rollers 25 and 26. Referring to FIG. 8 of the drawings, the diamond shaped areas 31 on the respective rollers 25 and 26 effectively reduce the area of roller contact with the tape band 17. This is more important when the tape dispensing device of the invention is used with an alternate wide film band 75 of pre-stretch film from a film roll 76. With the increased pressure on the rollers 25 and 26 do to the hereinbefore disclosed decreased roller contact area 31, the wide film band 75 tends to conform slightly with the overlapping of the grooves 29 and 30 for increased frictional engagement. The grooves 29 and 30 also dissipate a layer of air that normally builds up between the film band and the rollers when a wide film band 75 and the respective rollers 25 and 26 are operating at high speed during operation.

Referring back to the primary form of the invention, the tape guide bar 68 defines the relative infeed position of the tape band 17 from the tape supply storage roll 70 as best seen in FIG. 4 of the drawings. The knurled surface of the respective tape guide bars 68 and 69 prevent the adhesive tape band 17 from sticking inadvertently thereto at slow speeds and especially on guide bar 68 before the tape is pre-stretched which tends to diminish the adhesiveness of the tape band 17 somewhat. The tape guide bar 69 in contrast determines the outfeed position from the tape dispensing carriage 18 to the load 14. As the load 14 rotates on the turn table 13, the tape dispensing carriage 18 begins a corresponding vertical ascension with the tape dispensing carriage 19 moving independently within the tape dispensing carriage 18 as illustrated in broken lines in FIG. 2 and in FIG. 5 of the drawings. The ascension rate of the tape dispensing carriage 19 is calibrated so that it will reach a maximum travel as the tape dispensing carriage 18 also reaches maximum travel height selected in relation to the relative height of the load 14 being wrapped. This interdependency of the movable carriage assembly 19 and the movable carriage assembly 18 is critical to provide the ability for the tape band 17 to reach the top and the bottom of the load 14.

Referring to FIG. 5 of the drawings, it will be seen that at the completion of the wrapping cycle the tape dispensing carriage 18 has returned to a start position (as shown in broken lines). As the rotation of the load 14 slows and is about to stop the release clutch 37 within the roller drive assembly 21 disengages the rubber roller 25 thus matching the speed of the roller 26 stopping the pre-stretching i.e. elongation of the adhesive tape band 17 allowing for manual cutting of the band 17 to terminate the wrapping of the current load and also be available for the next load on which the non-stretched portion of the tape band 17 is pulled out and engaged thereon.

It will also now be apparent that the need for smooth roller section cover 32 on the rubber roller 26 since the non-stretched adhesive tape band 17 has maximum adhesion at this point in the wrapping cycle. The smooth roller section 32 allows slipping of the adhesive tape band 17 thereacross diminishing tape adhesive grab and thus the "snap back" which occurs if the rubber surface of the roller 25 was engaged at this critical time in the wrapping cycle.

Referring to FIGS. 2 and 8 of the drawings, a wide film adapter arm and hub assembly 71 can be seen that is pivotally extending from the support frame 20 adjacent the support frame plate 23 to provide adaptability of the tape dispensing device 10 so that if required standard rolls 76 of wide non-adhesive stretch film can be used by disabling the tape dispensing carriage 19 which movements are not required. The wide film adapter arm and hub assembly 71 comprises a tape hub 72 on an offset movable arm 73 that is pivotally secured to an L-shaped mounting arm 74 secured to the mounting plate 23 of the support frame 20 as hereinbefore described.

It will thus be seen that a new and novel tape dispensing wrapping device has been illustrated and described and it will be apparent from the above description that both the primary use of a tape film adhesive band 17 and the secondary use of a non-adhesive wide film band can be used with this device.

It will also be apparent to those skilled in the art that various changes and modifications may be made therein without departing from the spirit of the invention.

There I claim:

1. An improvement in pre-stretch wrapping machine for dispensing a web of wrapping material from a feed stock roll through a pre-stretch head to a non-symmetrical load supported on a turn table, the improvement comprises; a pair of movable carriage assemblies, a first carriage assembly having a pair of drive rollers, a first drive roller engaging a tape web of wrapping material and pulling the tape web from the feed stock roll, a second drive roller engaging the tape web of wrapping material from the first drive roller and pre-stretching said tape web between said first and second rollers, means for driving said first and second drive rollers, an infeed web guide bar between said first and second drive roller and the feed stock roll, an outfeed guide bar between said first drive roller and said load, a second carriage assembly within said first carriage assembly, said drive rollers having longitudinally spaced intersecting deep spiral grooves within said second carriage assembly comprising a tape supporting frame movably positioned on drive rails, a tape web mounting chuck on said tape supporting frame, means on said tape supporting frame for linear driving engagement with said drive rails, means for rotatably driving said drive rails, one of said drive rollers having an area of smooth non-resistant material inwardly from one end thereof, and a release clutch assembly on one of said drive rollers for selective roller engagement with said tape web.

2. The improvement in a pre-stretch wrapping machine for dispensing a tape web of wrapping material of claim 1 wherein said tape web comprises an adhesive tape band from a tape roll.

3. The improvement in a pre-stretch wrapping machine for dispensing a tape web of wrapping material of claim 1 wherein said drive rollers have a rubberized outer surface.

4. The improvement in a pre-stretch wrapping machine of claim 1 wherein said intersecting deep spiral grooves within said drive rollers define a plurality of diamond shape areas therebetween defining an area of increased non-grooved surface in relation to said diamond defining shaped deep spiral grooves.

5. The improvement in a pre-stretch wrapping machine of claim 1 wherein said infeed and outfeed guide bars have a knurled outer surface.

6. The improvement in a pre-stretch wrapping machine of claim 1 wherein said means on said tape support frame for linear engagement with said drive rails comprises linear directional bearing assemblies.

7. The improvement in a pre-stretch wrapping machine of claim 1 wherein said means for driving said first and second drive rollers comprise a roller drive assembly, said roller drive assembly comprising a drive motor, a release clutch and adjustable sheave interconnected thereto, a spring loaded sheave, an interengagement belt between said adjustable sheave and said spring loaded sheave, gear means interconnecting said second drive roller with said releasable chuck, a drive belt interconnecting said drive motor and said second drive roller.

8. The improvement in a pre-stretch wrapping machine of claim 1 wherein said means for rotatably driving said drive rails comprises, a drive rail assembly, said drive rail assembly comprises a drive motor, a drive sprocket on said drive motor, drive sprockets on each of said drive rails, drive chains interconnecting said drive sprockets on said drive motor and said drive sprockets on said drive rails, linear actuation bearings engageable on said respective drive rails.

9. The improvement in a pre-stretch wrapping machine of claim 1 wherein said web comprises a wide film band of stretchable plastic resin film.

10. The improvement in a pre-stretch wrapping machine of claim 1 wherein said second carriage assembly has a film adapter arm and hub assembly.

* * * * *